US005206709A

United States Patent [19]

Schewe et al.

[11] Patent Number: 5,206,709

[45] Date of Patent: Apr. 27, 1993

[54] APPARATUS FOR SENSING YARN MOVEMENT AND FOR SIGNALING BREAKAGE OF THE YARN

[75] Inventors: Richard A. Schewe, Loves Park; Richard J. Faehnrich, Niles; Timothy R. Fox, Chicago, all of Ill.

[73] Assignee: Reed-Chatwood, Inc., Rockford, Ill.

[21] Appl. No.: 763,975

[22] Filed: Sep. 23, 1991

[51] Int. Cl.[5] ..... G01N 21/89

[52] U.S. Cl. ..... 356/430; 250/561; 356/238

[58] Field of Search ..... 356/238, 429, 430, 431; 250/561

[56] References Cited

U.S. PATENT DOCUMENTS 4,027,982 6/1977 Ohishi ..... 350/561 X 4,341,958 7/1982 Ohsawa ..... 356/238

*Primary Examiner*—Vincent P. McGraw

*Attorney, Agent, or Firm*—Leydig, Voit & Mayer

[57] ABSTRACT

Yarn is guided along a linear path through a light beam which is directed toward a photoelectric detector. Non-uniformities in the surface texture of the yarn cause the intensity of the light received by the detector to fluctuate rapidly as long as the yarn is moving. If the yarn stops moving as a result of breakage, the intensity of the light remains constant, and the detector produces an electrical signal indicative of the breakage.

7 Claims, 4 Drawing Sheets

FIG. 7
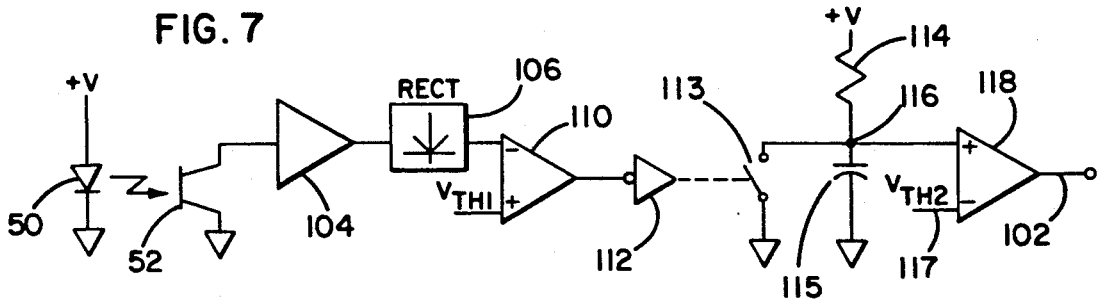
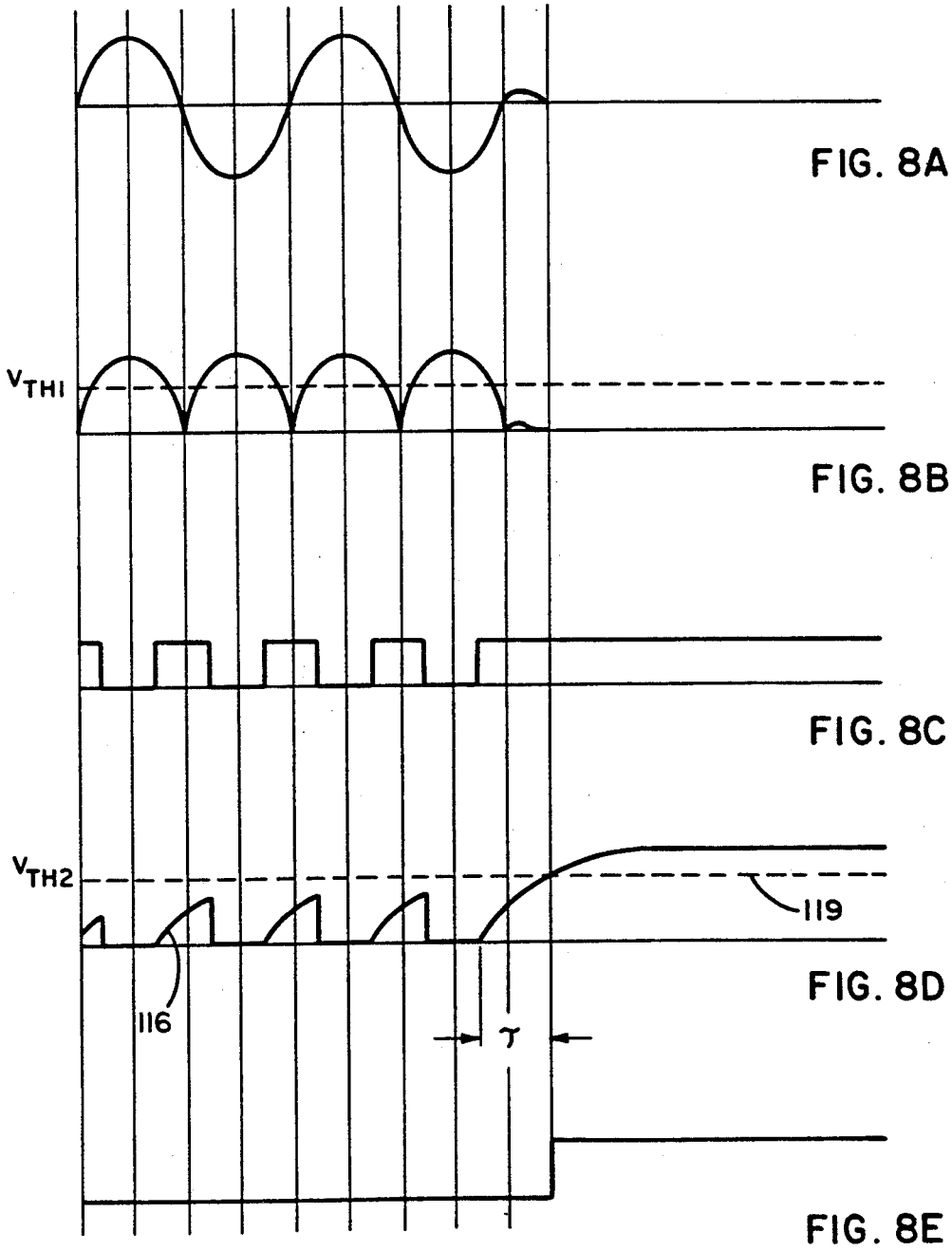
FIG. 8A
FIG. 8B
FIG. 8C
FIG. 8D
FIG. 8E

APPARATUS FOR SENSING YARN MOVEMENT AND FOR SIGNALING BREAKAGE OF THE YARN

BACKGROUND OF THE INVENTION

This invention relates generally to a yarn sensor and, more particularly, to a sensor which detects breakage of a moving strand of yarn and produces an electrical signal indicative of such breakage.

Yarn sensors of the invention may be used in conjunction with textile apparatus of the type having a creel and a warp drawing machine. In apparatus of this type, several (e.g., as many as 2500) individual yarn packages are supported by spindles of the creel. Strands of yarn are unwound from and pulled off of the individual packages by the rotatable beam of the warp drawing machine and are wound on the beam to form a warp sheet. Guide means confine each strand for movement along a predetermined path as the strand travels at very high speed from the yarn package to the beam.

If one of the strands breaks, it is necessary to stop rotation of the beam of the warp drawing machine as quickly as possible in order to simplify repair of the warp sheet being formed on the beam. In the past, mechanical switches such as drop wires have been used to detect yarn breakage and to produce an electrical signal effecting stopping of the beam. The drop wire rests on the moving strand and effects closure of switch contacts when the strand breaks. Drop wires require time-consuming threading of the strands through small eyes, have a relatively slow response time and require that the yarn be maintained under relatively high tension in order to prevent the switches from producing false signals and causing frequent "nuisance" stops.

Another type of yarn detector is an electronic motion detector which senses the "ballooning" movement of the yarn as the yarn is unwound from the package. In order for such a motion detector to function, the yarn must be moving in a looping path as the yarn passes the detector. Motion detectors of this type also have a relatively slow response time, require substantial floor space and, in order to prevent nuisance stops, can be activated only after the yarn has achieved relatively high speed (e.g., 400 yards per minute) and developed the proper "ballooning" motion. Thus, such detectors are not effective to detect breakage when the yarn is first starting to move during acceleration of the warper beam and when breakage is most likely to occur.

SUMMARY OF THE INVENTION

The general aim of the present invention is to provide a new and improved yarn sensor which possesses extremely fast response time, which minimizes nuisance stops without requiring the yarn to be under high tension, and which may be reliably activated at low yarn speeds so as to be capable of detecting breaks during initial acceleration of the warper beam.

A more detailed object of the invention is to achieve the foregoing by providing a sensor which optically detects linear movement of the yarn and which produces a breakage signal when the yarn stops.

A related object is to provide a photoelectric yarn sensor which makes advantageous use of inherent nonuniformities in the surface texture of the yarn in order to optically detect linear movement of the yarn and to produce a breakage signal when such movement stops.

A further object is to provide a photoelectric yarn sensor which is substantially insensitive to variations in ambient lighting. In that regard, it is a detailed object to provide such a sensor with electronic means for distinguishing between non-systematic ambient light variations and variations due to the presence or absence of movement of the sensed yarn.

According to another aspect of the invention, it is an object to provide a photoelectric yarn sensor in which the response time of the sensor to a yarn break is relatively independent of the signal level generated during sensing of the yarn.

The invention also resides in the incorporation of the sensor into a novel wear-resistant guide which coacts with a light-transmitting holder to guide the yarn along a linear path through a light beam without the yarn rubbing against and abrading the holder.

These and other objects and advantages of the invention will become more apparent from the following detailed description when taken in conjunction with the accompanying drawings.

BRIEF DESCRIPTION OF THE DRAWINGS

FIG. 7 is a block diagram better illustrating the principles of the retriggerable multivibrator portion of the system of FIG. 6.

FIGS. 8A–8E illustrate a set of waveforms useful in understanding the operation of the system of FIG. 7.

DETAILED DESCRIPTION OF THE PREFERRED EMBODIMENT

Figure 1:
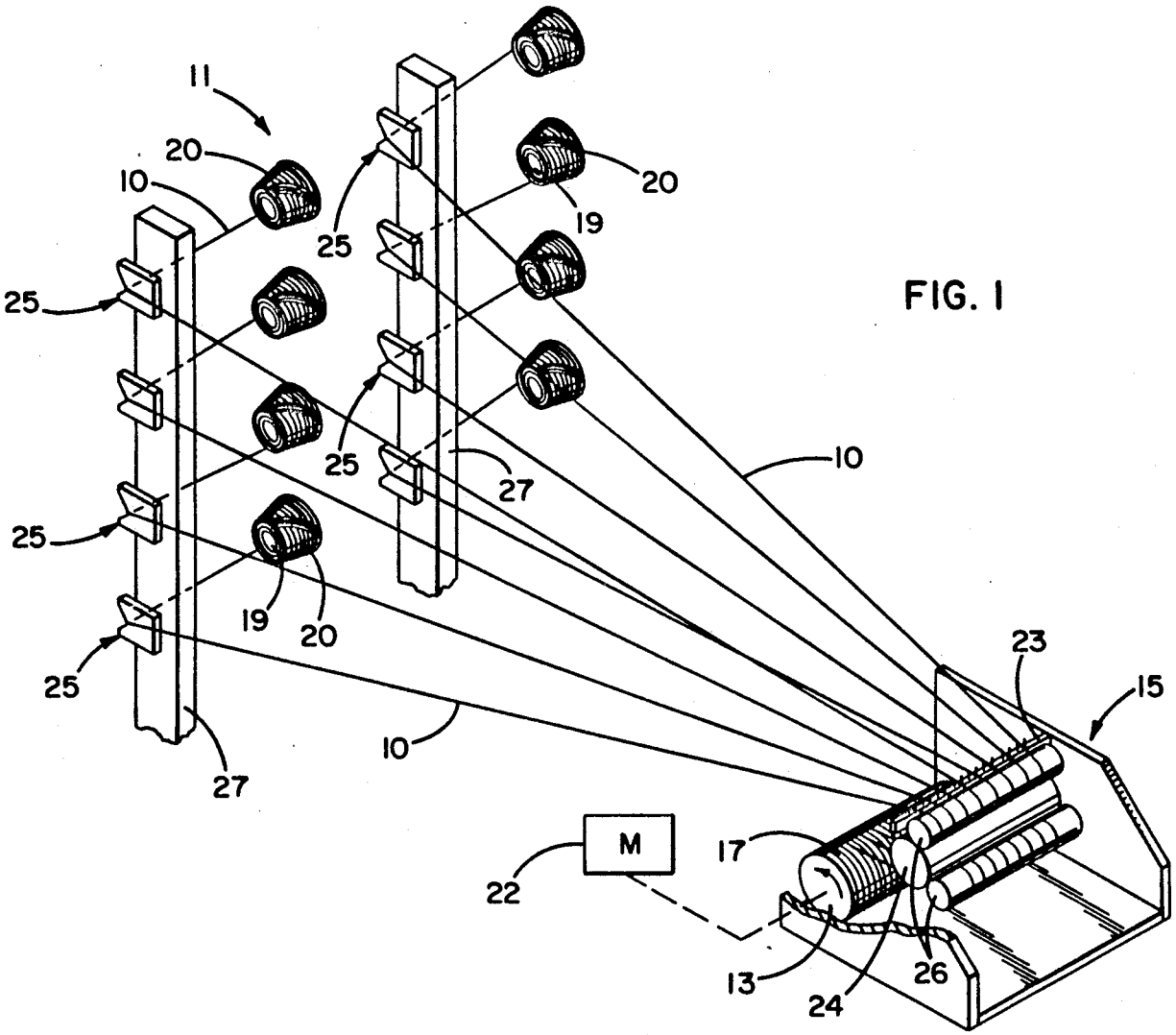
FIG. 1 is a perspective view schematically showing yarn sensors incorporating the unique features of the present invention in association with a typical creel and warp drawing machine.

For purposes of illustration, the invention has been shown in the drawings in conjunction with textile apparatus of the type in which multiple strands 10 of yarn from a creel 11 are wound around the beam 13 of a warp drawing machine 15 to form a warp sheet 17 on the beam. Both the creel and the warp drawing machine are of well known construction. The creel may include as many as 2500 spindles 19 each supporting a yarn package 20 formed in part by an inner paper or plastic cone around which the yarn 10 is helically wound. The yarn is unwound from each package upon being pulled off of the package at high speeds (e.g., up to 1200 yards per minute) by the beam 13 of the warp drawing machine 15.

The warp drawing machine 15 may be similar to that disclosed in Schewe U.S. Pat. No. 4,890,368. As shown schematically in FIG. 1, the beam 13 of the machine is supported to turn about a horizontal axis and is rotated in a counterclockwise direction about that axis by a drive motor 22. During rotation of the beam, the strands 10 from the yarn packages 20 pass through a comb 23 and are wound tightly around the beam. A delivery roller 24 and two nip rollers 26 lead the strands from the comb to the beam and isolate the tension in the strands at the beam from the tension of the strands at the creel 11.

Each strand 10 from a yarn package 20 is constrained to move along a predetermined path as the strand is drawn off of the package by the beam 13. For this purpose, vertically spaced guides 25 are supported by upwardly extending masts 27, there being one guide associated with each yarn package. In this particular instance, the strand 10 from each package 20 moves axially away from the package along a substantially horizontal path, passes around the guide 25 and then moves toward the beam 13 along a path extending generally at a right angle to the horizontal path.

If any one of the strands 10 breaks, rotation of the beam 13 must be stopped as quickly as possible to facilitate repair of the warp sheet 17. The longer the beam rotates after breakage, the deeper the broken yarn end on the beam becomes buried by other strands and thus greater time and effort is required to retrieve the broken end and re-establish a continuous strand.

The present invention contemplates the provision of a unique sensor 30 which detects linear motion of the yarn 10 and which relies on the inherent non-uniformity of the surface texture of the yarn to determine whether the yarn is or is not moving. If the yarn stops moving as a result of breaking, the sensor produces a signal effective to stop rotation of the beam 13. As will become apparent subsequently, the sensor responds to yarn breakage in an extremely short period of time and is capable of operating effectively and without producing false signals even when the yarn is under low tension and is traveling at relatively low speeds.

Figure 3:
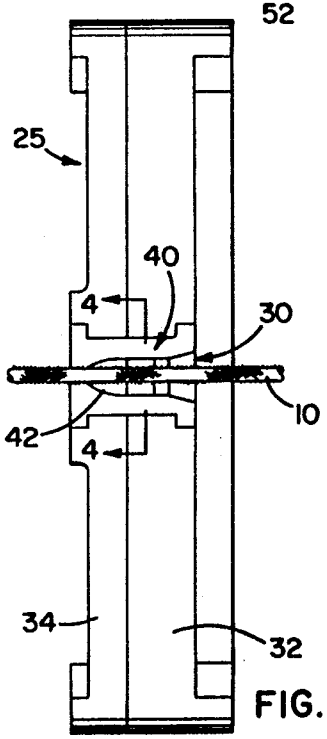
FIG. 3 is a rear elevational view of the sensor shown in FIG. 2.

One sensor 30 is associated with each strand 10 of yarn and, in this particular instance, each sensor forms part of the guide 25 for directing the strand from the yarn package 20 to the warper beam 13. Herein, each guide 25 includes a two-piece housing molded of Delrin or the like and including a back cover 32 (FIGS. 3 and 5) which is suitably secured to the mast 27 by screws or the like. The housing further includes a front cover 34 secured to the back cover and coacting therewith to define an internal chamber 35 (FIG. 5) between the two covers.

A nose 40 made of smooth, hard and long-wearing material such as porcelain is bonded to the covers 32 and 34 adjacent the rear ends thereof and defines a throat 42 for guiding the yarn 10 in a linear path past the sensor 30 and then around the mast 27. The throat 42 is generally V-shaped in side elevation and includes upper and lower entrance surfaces 44 (FIG. 5) which engage the yarn 10 being pulled off of the yarn package 20 and guide the yarn in a straight path past the sensor 30. Spaced laterally from the entrance surfaces 44 of the throat 40 are exit surfaces 46 which engage the yarn after the yarn passes the sensor and which guide the yarn along a straight path for a short distance beyond the sensor. Thereafter, the throat surfaces are radiused as indicated at 48 in FIG. 5 and guide the yarn in a curved path around the mast 27 and toward the warp drawing machine 15.

The sensor 30 includes a light source 50 (FIG. 4) located on one side of the path followed by the yarn 10 as the yarn travels through the throat 42, the light source being operable to cast a beam of light across the path and herein being in the form of an infrared light-emitting diode. Located on the opposite side of the path from the LED 50 is a photoelectric detector 51 for receiving the beam of light. In this particular instance, the photoelectric detector is a phototransistor. The LED 50 and the phototransistor 52 are located in opposing pockets 54 and 56, respectively, formed in a holder 58 made of transparent acrylic and disposed within the chamber 35 between the two covers 32 and 34. The holder is suitably secured to one of the covers and supports a circuit board 60 which carries circuitry for the sensor 30.

Figure 5:
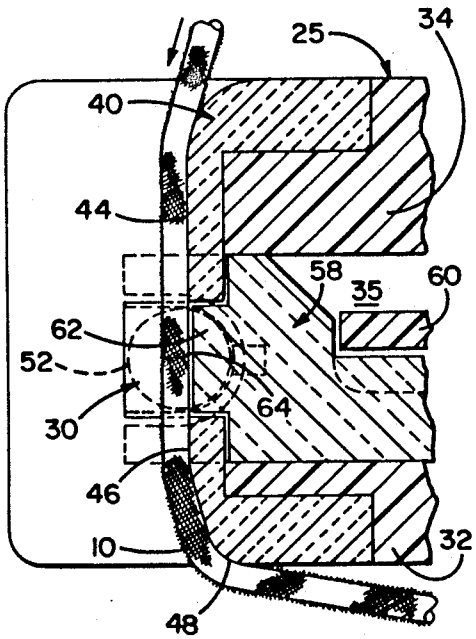
FIG. 5 is an enlarged fragmentary cross-section taken substantially along the line 5—5 of FIG. 2.
Figure 2:
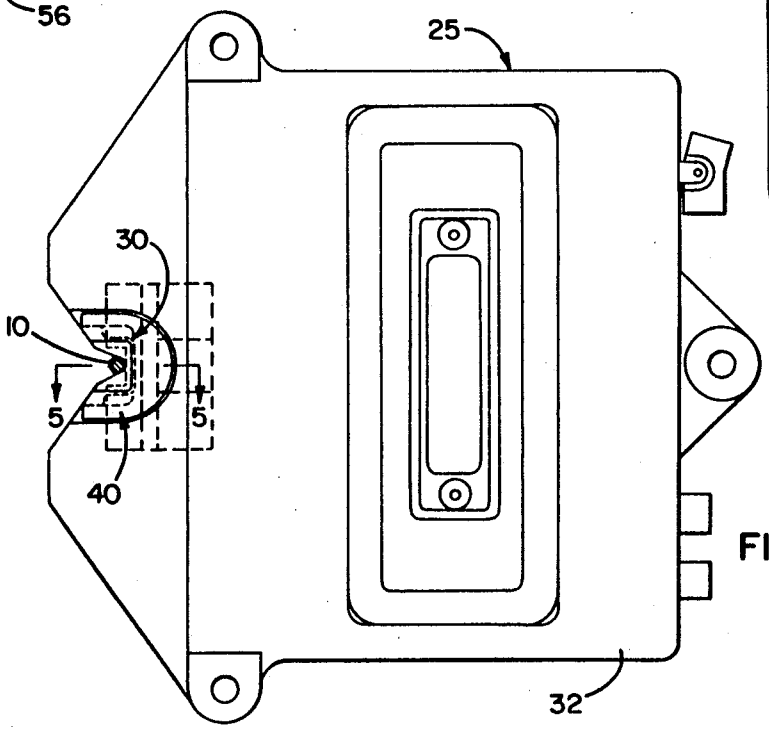
FIG. 2 is an enlarged side elevational view of one of the yarn sensors shown in FIG. 1.
Figure 4:
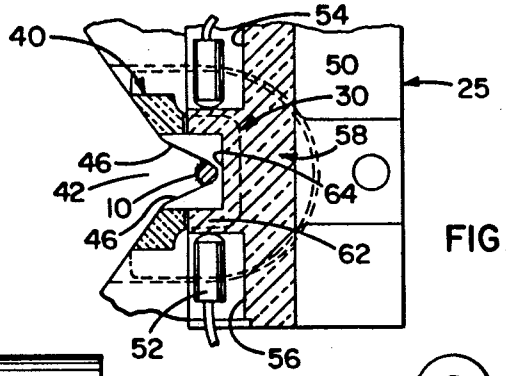
FIG. 4 is an enlarged fragmentary cross-section taken substantially along the line 4—4 of FIG. 3.

As shown most clearly in FIGS. 4 and 5, the holder 58 is formed with a rearwardly projecting tongue 62 which is located vertically between the LED 50 and the phototransistor 52 and which defines part of the pockets 54 and 56 for those components. Being of transparent acrylic, the tongue allows the light beam from the LED to be transmitted to the phototransistor.

The tongue 62 of the holder 58 extends rearwardly between the laterally spaced entrance surfaces 44 and exit surfaces 46 of the throat 42 of the nose 40 and is formed with a U-shaped throat 64 (FIG. 4) which accommodates the yarn 10. The throat 64 of the holder 58, however, is spaced forwardly of the entrance and exit surfaces 44 and 46 of the throat 42 and thus the latter surfaces hold the yarn 10 out of rubbing engagement with the surfaces of the throat 64. In this way, the yarn only rubs against the relatively hard porcelain surfaces of the nose 40 and does abrade the clear surfaces of the throat 64 of the holder 58. This helps maintain a clear optical window through the acrylic of the tongue 62 between the LED 50 and the phototransistor 52.

The yarn 10 is formed from textile fibers and thus has a non-uniform surface texture. That is to say, the surface texture of the yarn 10 is non-uniform and fuzzy when compared, for example, to the smooth surface of a monofilament strand made of synthetic material.

As a result of the non-uniformity of the surface texture of the yarn 10, the intensity of the light beam received by the phototransistor 52 fluctuates rapidly as the yarn moves through the light beam. In carrying out the invention, the intensity of the light beam is sensed and, if the intensity remains constant for a predetermined period of time indicating that the yarn has stopped, an electrical signal is produced to stop rotation of the warper beam 13.

Figure 6:
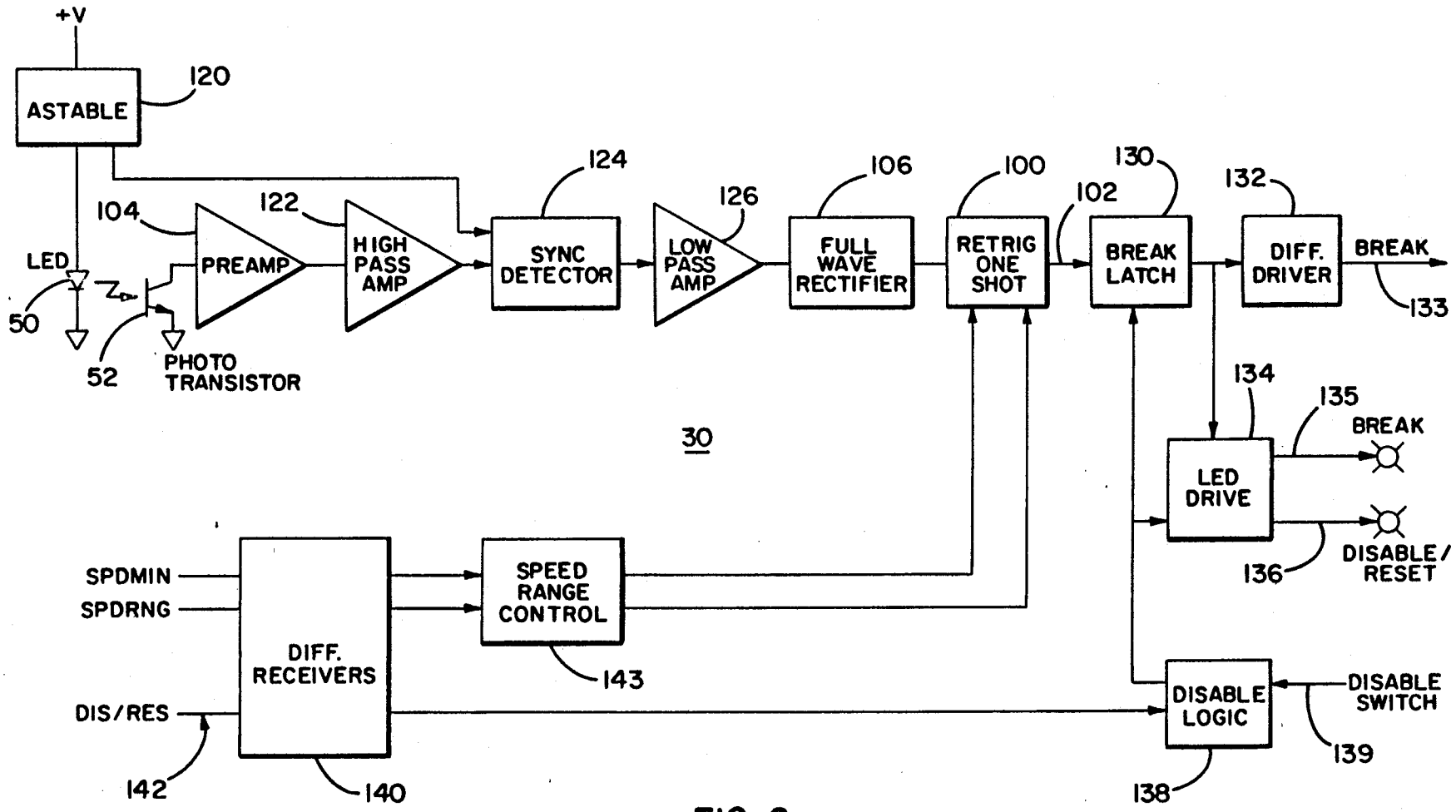
FIG. 6 is a block diagram illustrating the relationship between the electronic elements of the yarn sensor.

For this purpose, the LED 50 and phototransistor 52 are arranged in a circuit configuration illustrated in FIG. 6 to produce at the output 102 of a retriggerable multivibrator 100 a signal which has a first stable state when the presence of a moving yarn causes fluctuation in the light intensity transmitted from the LED to the phototransistor, and a second stable state when the absence of a moving yarn allows a steady transmission of light between those elements. The system 30 of FIG. 6 includes a number of other features which will be described in greater detail below. For the moment, however, attention will first be directed to FIG. 7 for a better understanding of the structure and functionality of the retriggerable multivibrator 100 in sensing the presence or absence of light fluctuations caused by the presence or absence of a moving yarn in the sensor.

FIG. 7 shows at the left thereof the LED 50 optically coupled to phototransistor 52. For the sake of simplicity, FIG. 7 illustrates the LED as being connected across the power supply for continuous illumination thereof. The phototransistor 52 is coupled to a preamplifier 104 which serves to amplify the signal and particularly the rapid fluctuations in the signal caused by the yarn with its non-uniform surface texture moving through the light beam which couples the LED 50 to the phototransistor 52. For the purpose of emphasizing the AC signal, conventional AC coupling techniques are used in the amplifier arrangement represented by the block 104 shown in FIG. 7. In other words, the DC component of the signal may be removed, and the output of amplifier 104 is a fluctuating signal originating from the fluctuating interruption of the light beam by the random fibers of the yarn. A rectifier 106 receives the fluctuating signal (which has positive and negative variations) and produces a unipolar signal in which all of the variations are transposed to a positive level. The thus amplified and rectified AC signal, which is representative of fluctuations in the light intensity in the sensing region, is passed to a retriggerable multivibrator represented by the elements bracketed at 100.

Those elements include a comparator in the form of a first operational amplifier 110 having its non-inverting input coupled to a reference or threshold voltage identified as $V_{TH1}$, and its inverting input coupled to the output of rectifier 106. The threshold applied to the comparator 110 sets the level above which trigger pulses will cause the output of comparator 110 to respond. Thus, the threshold can be established such that the comparator 110 will be insensitive to noise but will cause an output swing for each pulse in the fluctuating AC signal from the rectifier 106. The output of comparator 110 is coupled to an electronic switch represented by gate 112 having a control output coupled to a switch 113. For each pulse at the output of rectifier 106 which causes a response by comparator 110, the gate 112, switch 113 combination will cause a momentary closure of the switch 113. A resistor 114 and capacitor 115 are shown coupled across the power supply so as to be in a continual mode for charging of the capacitor 115 at a rate determined by the RC time constant of the elements 114, 115. Each time, however, the gate 112 causes the switch 113 to temporarily close, the capacitor 115 will be discharged to re-initiate the charging period thereof. Thus, for so long as a moving yarn is present in the sensing path between LED 50 and phototransistor 52, the continuing pulses will pass through the circuitry to cause rapid closures of switch 113, continuing to discharge the capacitor 115 and re-initiate its charging interval. That operation will keep the level at a node 116 (between the resistor 114 and the capacitor 115) below a second threshold level $V_{TH2}$ which is applied to the non-inverting input 117 of a comparator in the form of a second operational amplifier 118. As a result, the output of comparator 118 (the break signal found on output 102) will be maintained at a high logic level, indicating the presence of a moving yarn in the particular sensing gap.

However, if the yarn breaks and thus stops, the aforementioned elements will function in the following manner. In contrast to the varying light intensity beam passed from LED 50 to phototransistor 52 when a moving yarn is present, the absence of a moving yarn causes a beam of substantially steady intensity to be passed from the LED to the phototransistor, resulting in a substantially constant signal at the output of amplifier 104. As a result, there will be no pulses at the output of rectifier 106, and the comparator 110 which serves as the input of the retriggerable multivibrator will have no pulses at its output. The gate 112, switch 113 arrangement thus will maintain the switch 113 in the open, illustrated condition, allowing the capacitor 115 to charge through resistor 114 until the node 116 reaches a level which exceeds the threshold $V_{TH2}$ imposed on non-inverting input 117 of comparator 118. As a result, the output of the comparator 118 will swing to its opposite logic level, in this case, a logic high, causing the break signal output 102 to switch to its opposite logic level and indicate that the yarn in the sensor has broken.

The manner in which that is accomplished is better illustrated with reference to FIGS. 8A–8E. FIG. 8A is an idealized waveform of the signal at the output of preamplifier 104 in the presence of a moving yarn in the gap between the LED 50 and phototransistor 52. It will be appreciated that in normal circumstances the waveform is much more irregular and perhaps less sinusoidal, but the illustration of FIG. 8A will suffice. It is noteworthy that FIG. 8A is centered about the zero axis, illustrating that the DC component has been removed. FIG. 8B shows the output of the rectifier 106 in which the negative half waves are rectified so that all of the pulses appear above the zero level. The threshold $V_{TH1}$, applied to the non-inverting input of comparator 110 is shown as a dashed line in FIG. 7B.

FIG. 8C illustrates the output of the comparator 110 in which the output is at a logic low whenever the input signal exceeds the threshold $V_{TH1}$ and is at a logic high whenever it does not. Thus, the output of comparator 110 is in the form of a square wave in which logic high signals are produced whenever the input signal is below the threshold, and logic low signals are produced whenever the input signal is above the threshold.

FIG. 8D shows the voltage at the node 116 between the resistor 114 and capacitor 115. The threshold $V_{TH2}$ is illustrated by dashed line 119. It is seen that so long as the pulses resulting from the yarn interrupting the beam are sufficiently rapid, the waveform 116*a* (representing the voltage across capacitor 115) is prevented from charging to the level set by threshold $V_{TH2}$. Thus, the voltage at node 116 begins to rise whenever the waveform of FIG. 8C switches high, but is immediately discharged when the waveform of FIG. 8C switches low. It is seen that so long as the pulses generated by the moving yarn are sufficiently rapid, the voltage across capacitor 115 is maintained at a level below the threshold $V_{TH2}$. However, as seen at the right-hand portion of FIG. 8A, the fluctuating signal at the output of amplifier 104 is caused to cease (as by a yarn breakage), with the result being an absence of pulses at the output of the rectifier 106 (FIG. 8B) and a continued high output from the comparator 110 (FIG. 8C). As a consequence, there is no signal for closing the switch 113 to discharge the capacitor 115, and the capacitor continues to charge, ultimately exceeding the threshold $V_{TH2}$. FIG. 8E shows that after a period $\tau$, representing the time constant of the RC network of resistor 114 and capacitor 115, the threshold $V_{TH2}$ is exceeded, and the break signal switches from a logic low to a logic high.

It is noteworthy that the detection of the broken yarn occurs within a very short period $\tau$ irrespective of the frequency of the fluctuating signal caused by the interfering yarn. In other words, it will be appreciated from an examination of FIGS. 8A through 8E, that whenever the fluctuating signal stops, the capacitor 115 need only charge from at most its zero level to the threshold $V_{TH2}$, and that will always happen within the interval $\tau$. As a result, the detector of the present invention will be highly responsive to a break in the yarn, and the response time is substantially unaffected by the signal levels in the circuit. More particularly, all that need occur is that pulses from the interfering yarn be absent for the period $\tau$ (which can be on the order of 30 milliseconds or less), and the failure of a pulse to appear within that 30 millisecond interval will cause a response at the break signal output 102 which will be sensed by subsequent circuitry. Even if the subsequent circuitry is programmed, for example, to require multiple occurrences of the break signal on line 102 before initiating a machine shutdown, that does not detract from the fact that the break detector of the present invention will be capable of producing a reliable response within a very brief interval, such as the 30 milliseconds noted above.

An important aspect of the invention is the utilization of the fluctuating signal created by the yarn with its surface texture moving through the light beam, and the ability of the electronic circuitry to rapidly respond to the absence of that fluctuation indicating a broken yarn. The ability of the retriggerable multivibrator exemplified by the circuit diagram of FIG. 7 in providing that rapid response has now also been described. It is worthwhile to contrast the rapid response achieved by the retriggerable multivibrator with what might have been achieved utilizing more conventional electronic techniques, such as a standard RC timing circuit which is directly responsive to the fluctuating signal. Consider, for example, utilizing a waveform such as that illustrated in FIG. 8A, rectified as shown in FIG. 8B, and charging a capacitor through a timing resistor directly from that response. The charge maintained on the capacitor would clearly be a direct function of signal strength, and signal strength in turn could be impacted by variations in power supply voltage, variations in intensity from the LED, ambient light conditions or fluctuations, the character of the yarn being passed through the machine, etc. The yarn break detector would thus respond differently depending upon the signal strength of the fluctuating signal. For a strong signal, the capacitor would be charged to a higher level than it would be if the signal were weaker. With a standard RC timing arrangement, an adequate charge on the capacitor would indicate that the yarn is in place, and the lack of a yarn, exemplified by the lack of pulses from the rectifier (the right-hand portion of FIG. 8B) would then allow the capacitor to begin to discharge to a known threshold level. The length of time it would take that capacitor to discharge would be very dependent on the initial charge created by the signal strength. Thus, for a strong signal, the response time of the system to a yarn break would be longer than it would be in conditions when the fluctuating signal were at a lower level.

Those problems are avoided by the use according to the invention of the retriggerable multivibrator which simply requires the lack of a fluctuation during a predetermined preset interval (such as 30 milliseconds). If a fluctuation is not present for that length of time, the system will trigger irrespective of the signal strength of the fluctuations which had until that point prevented triggering of the system.

In addition to the two features discussed just above, as a further feature of a preferred system constructed in accordance with the present invention, additional means are provided for rendering the system relatively insensitive to ambient light variations.

Turning again to FIG. 6, it is seen that in accordance with the invention means are provided for modulating the light beam before transmission and for synchronously demodulating the received light beam in order to minimize the responsiveness of the system to alterations in ambient light conditions.

Referring in greater detail to FIG. 6, it is seen that the LED 50 is not driven directly from a constant DC supply as was described in connection with FIG. 7, but instead is driven by way of an astable multivibrator 120 adapted to modulate the light beam transmitted to the phototransistor 52. The signal created by the received light beam is thereafter synchronously detected (synchronously with respect to the period of the astable multivibrator). To minimize responsiveness of the system 30 to unwanted interference, such as that caused by fluctuations in the ambient light. The astable multivibrator 120 is preferably selected to have a relatively high frequency, such as 40 kHz. Thus, the LED 50 is switched on and off at a 40 kHz rate to produce a pulsed light beam transmitted to the phototransistor 52 at the 40 kHz rate. The phototransistor will respond and will thus impose the yarn signal (the fluctuations caused by the rough surface of the moving yarn interrupting the light beam, often at about 4 kHz) to modulate the 40 kHz pulse train produced by the pulsed light beam. The signal produced by the phototransistor is passed through a preamplifier 104 and thereafter through a high pass amplifier 122. It is noted that the functions of the amplifiers 104, 122 can be combined if desired. The purpose of the high pass character of the amplifier 122 is to filter out the frequency substantially below the 40 kHz carrier, and thus to eliminate the noise signal typically found at about 1 kHz, or the DC shift caused by more gradual ambient lighting shifts. Thus, the signal which passes through the amplifier 104, 122 combination is primarily the 40 kHz carrier modulated by the yarn signal. The interference is not adequately systematic to modulate the 40 kHz carrier, and the unmodulated interference will be incapable of passing the amplifier 122. The modulated signal is thereafter applied to a synchronous detector 124 which receives one input from the amplifier 122 and a second input from the astable multivibrator 120. The synchronous detector operates in relatively conventional fashion to accept the modulation signal at the output of amplifier 122 (which is both positive and negative) and to multiply those signals by substantially the same gain, but of opposite sign, to produce an output from the synchronous detector 124 which is unipolar but contains all of the modulation information. Thus, the signal from the astable multivibrator 120 is utilized to drive the synchronous detector 124 to select either a positive or a negative multiplication factor (plus 0.6 and −0.6 being preferred in one implementation of the invention), and to apply that selectable gain to the output of the amplifier 122, in time with the modulation which had alternated the polarities, to produce a unipolar modulation signal at the output of the synchronous detector 124. That signal is passed through a low pass amplifier 126 which has the function of eliminating the 40 kHz carrier. Thus, the output of amplifier 126 is primarily the modulation signal, at the modulation frequency (about 4 kHz), with the modulating signal (40 kHz) as well as the nonsystematic interfering signal (the noise at 1 kHz or lower) removed.

It will thus be appreciated that the elements described thus far have produced at the output of amplifier 126 a fluctuating signal in which the individual fluctuations are the result of fibers of the yarn interrupting the light beam passing from LED 50 to phototransistor 52. As was described in connection with the FIG. 7 simplified diagram, the fluctuating signal is rectified in a full wave rectifier 106 and passed to a retriggerable one-shot multivibrator 100, illustrated as a single block in FIG. 6. In the preferred embodiment, the unipolar output of the synchronous detector and low pass filter is AC coupled to the rectifier. Thus, the DC components of the low pass filter is removed. The one-shot operates as described in connection with FIG. 7 to produce an output signal on line 102 having a logic level indicating whether the yarn is moving in the sensor and creating the fluctuating signal, on the one hand, or has broken and stopped with the result being the absence of a fluctuating signal, on the other hand.

In the illustrated embodiment, the retriggerable one-shot output signal is passed to a break latch 130 which is driven to one of its stable states whenever the retriggerable one-shot 100 detects a yarn break. When in the break condition, the latch 130 operates through a differential driver 132 to produce an output signal 133 which is coupled back to a system controller indicating that the particular yarn monitored by the sensor 30 has broken. The break latch 130 is also coupled to an LED drive circuit 134 which drives a pair of local LED's at the particular yarn break detector. A first LED 135 is illuminated to indicate that the particular yarn sensed by that detector has broken. A second LED 136 is provided for illumination whenever the particular sensor has been disabled. Disable logic 138 is driven from a switch 139 on the one hand or from computer driven logic circuitry 140 on the other. The disable logic 138, when driven to its disable condition, operates upon the LED drive circuit 134 to illuminate the LED 136, indicating that the yarn sensor 30 in question has been disabled. The disable logic 138 also operates on break latch 130 to prevent the setting thereof, preventing the break latch 130 from operating through the differential driver 132 to signal a break via output line 133. However, when the system 30 is intended to be functional, the disable logic 138 provides a signal to remove the reset function from the break latch, and extinguish the LED 136, allowing the system to function as described above.

For the sake of completeness, it is seen that a set of differential receivers 140 are provided responsive to a set of connections 142 provided to a central controller intended to allow the central controller to operate the disable logic 138. The differential receivers also operate through a speed range control 143 which is intended to change the resistance value of the resistor 114 of the retriggerable one-shot 100 in accordance with the speed range at which the particular machine is being operated. In other words, if the machine is operated at a relatively high speed, the speed range control 143 can be used to set a shorter period $\tau$, the interval during which the absence of a fluctuation will trigger the system. If the machine is intended for operation at a higher speed, the speed range control 143 requires a longer interval $\tau$ before the retriggerable one-shot 100 will determine that the yarn has broken. The details of the differential receiver 140 and the speed range control 143 (which primarily establishes the trigger point for the retriggerable one-shot) are not important to an understanding of the present invention, and will not be further described herein.

It will now be appreciated that what has been provided is an improved apparatus for sensing yarn movement and for signalling breakage of the yarn. The system dispenses with the need for drop switches riding on the yarn, and also does away with the problems associated with electronic sensors which rely on "ballooning". Instead, the yarn detector of the present invention simply creates a light beam through which the yarn passes, and relies on the surface roughness of the yarn causing fluctuations in the received light beam to create a fluctuating signal indicating the presence of the yarn.

With respect to the circuitry which responds to that fluctuating signal, first of all, means are provided for creating trigger pulses from the fluctuations in the signal, and using the trigger pulses to retrigger a retriggerable multivibrator. In the absence of a moving yarn, the yarn fluctuation signal ceases, causing the trigger pulses to cease, causing an almost immediate response from the multivibrator which has thus ceased to be retriggered. The improvement in response time of such a system will now be readily apparent.

In addition, means are provided for rendering the system relatively insensitive to noise such as fluctuations in the ambient lighting conditions. To that end, the light beam which generates the fluctuating signal is modulated at a relatively high frequency, such that the yarn interrupting the modulated light beam creates a modulated signal carrying the fluctuations, and that modulated signal does not carry the non-systematic noise or interference. The modulated signal with yarn fluctuations is then synchronously demodulated to create a fluctuating yarn signal devoid of noise, and that signal is then processed by the retriggerable one-shot to provide a system, preferred according to the invention, which is not only relatively insensitive to ambient noise, but which also has a very rapid response time.

We claim:

1. Apparatus for sensing lengthwise movement of a strand of yarn of non-uniform surface texture and for producing an electrical signal when the yarn stops, said apparatus comprising a guide for causing the yarn to travel along a predetermined and substantially linear path, a light source located on one side of said path for casting a beam of light across said path, a photoelectric detector located on the opposite side of said path in opposing relation with said light source to receive said beam, said guide comprising a nose made of wear-resistant material and having a throat for guiding said yarn along said path, said throat having entrance surfaces engageable with said yarn before the yarn reaches said beam and having exit surfaces spaced along said path from said entrance surfaces and engageable with said yarn after the yarn passes through said beam, a holder of light-transmitting material having a tongue projecting into said throat between said entrance and exit surfaces, pockets in said tongue and receiving said light source and said photoelectric detector, said tongue having a yarn-receiving throat located between said pockets, said entrance and exit surfaces of the throat of said nose holding said yarn out of engagement with the throat of said holder, said detector producing an output signal whose frequency varies as a function of changes in the intensity of said beam, the intensity of the beam received by said detector changing during movement of said yarn due to non-uniformity of the surface texture of the yarn, and means responsive to the output signal of said detector for producing said electrical signal when the frequency of said output signal remains substantially constant for a predetermined period of time.

2. Apparatus for sensing lengthwise movement of a strand of yarn of non-uniform surface texture and for producing an electrical signal indicating the absence of yarn movement, said apparatus comprising a guide for causing the yarn to travel along a predetermined path, a light source located on one side of said path for casting a beam of light across said path, a photoelectric detector located on the opposite side of said path in opposing relation with said light source to receive said beam, said path being arranged so that the surface texture of the yarn produces fluctuations in the intensity of the beam received by the detector when the yarn is moving, means responsive to the detector for producing a fluctuating signal having a frequency content responsive to said variations, a retriggerable multivibrator adapted for retriggering by said fluctuating signal, and the multivibrator having a period adapted to produce said electrical signal when the frequency content of said fluctuating signal falls below said period.

3. The apparatus as set forth in claim 2 wherein the retriggerable multivibrator has a period of about 30 milliseconds, whereby the absence of a moving yarn in the path will be sensed by said apparatus within a period which does not substantially exceed 30 milliseconds.

4. The apparatus as set forth in claim 2 further including means for modulating the light source to produce a modulated beam of light, the means responsive to the detector thereby producing a modulated signal with said frequency content, and synchronous means for receiving said modulated signal for demodulation thereof.

5. The apparatus as set forth in claim 2 further including an astable multivibrator for pulsing the light source on and off at a predetermined relatively high carrier frequency, the detector responding to said pulsed light beam to produce a modulated signal carrying said frequency content, synchronous detector means responsive to said modulated signal for separating the frequency content from the carrier frequency thereby to produce a signal having said frequency content but substantially free of noise, filter means for eliminating the carrier frequency, and means for applying the filtered signal to the retriggerable multivibrator.

6. The apparatus as set forth in claim 2 wherein the retriggerable multivibrator includes means for receiving trigger signals having a frequency related to said frequency content, a charging circuit for charging a capacitor at a predetermined rate, switch means for discharging the capacitor in response to each trigger signal, and comparator means having a threshold level and for sensing the charge, the comparator means serving to produce said electrical signal whenever the charge on the capacitor exceeds said threshold level as a result of the lack of trigger signals indicating the lack of said frequency content in said signal.

7. The apparatus as set forth in claim 5 wherein the retriggerable multivibrator includes means for receiving trigger signals having a frequency related to said frequency content, a charging circuit for charging a capacitor at a predetermined rate, switch means for discharging the capacitor in response to each trigger signal, and comparator means having a threshold level and for sensing the charge, the comparator means serving to produce said electrical signal whenever the charge on the capacitor exceeds said threshold level as a result of the lack of trigger signals indicating the lack of said frequency content in said signal.

* * * * *